US007077795B2

(12) United States Patent
Chen

(10) Patent No.: US 7,077,795 B2
(45) Date of Patent: Jul. 18, 2006

(54) FEET-BINDING APPARATUS FOR A TILTING INVERSION EXERCISE MACHINE

(75) Inventor: Shi-Lin Chen, Taichung (TW)

(73) Assignee: LifeGear, Inc., El Monte, CA (US)

( * ) Notice: Subject to any disclaimer, the term of this patent is extended or adjusted under 35 U.S.C. 154(b) by 153 days.

(21) Appl. No.: 10/912,208

(22) Filed: Aug. 5, 2004

(65) Prior Publication Data

US 2006/0030466 A1 Feb. 9, 2006

(51) Int. Cl.
*A63B 26/00* (2006.01)

(52) U.S. Cl. ..... 482/145; 482/144

(58) Field of Classification Search ..... 482/144–145, 482/79–80; D21/686–690; 128/845–848; 602/32

See application file for complete search history.

(56) References Cited

U.S. PATENT DOCUMENTS

| | | | | | |
|---|---|---|---|---|---|
| 3,286,708 | A | * | 11/1966 | Gartner | 601/5 |
| 4,232,662 | A | * | 11/1980 | Barber | 482/144 |
| 4,438,761 | A | * | 3/1984 | McGowen | 482/144 |
| 4,444,178 | A | * | 4/1984 | Kuo | 482/144 |
| 4,494,532 | A | * | 1/1985 | Masuda et al. | 482/38 |
| 4,531,731 | A | * | 7/1985 | Law | 482/144 |
| 4,534,555 | A | * | 8/1985 | McGowen | 482/144 |
| D280,537 | S | * | 9/1985 | Law | D21/688 |
| 4,624,458 | A | * | 11/1986 | Fendrik | 482/144 |
| 4,672,697 | A | * | 6/1987 | Schurch | 5/610 |
| 4,717,148 | A | * | 1/1988 | Brewer | 482/144 |
| 4,867,143 | A | * | 9/1989 | Morin | 606/244 |
| 4,890,604 | A | * | 1/1990 | Nelson | 602/32 |
| 5,551,937 | A | * | 9/1996 | Kwo | 482/144 |
| 5,695,438 | A | * | 12/1997 | Bj.o slashed.rnsti | 482/144 |
| 5,718,660 | A | * | 2/1998 | Chen | 482/144 |
| 6,030,325 | A | * | 2/2000 | Ottoson et al. | 482/144 |
| 6,149,560 | A | * | 11/2000 | Kim | 482/145 |
| 6,637,055 | B1 | * | 10/2003 | Nanan | 5/610 |
| 6,679,818 | B1 | * | 1/2004 | Hsien | 482/144 |
| 6,814,691 | B1 | * | 11/2004 | Kuo | 482/145 |
| 2003/0153442 | A1 | * | 8/2003 | Kuo | 482/144 |
| 2003/0162639 | A1 | * | 8/2003 | Hsien | 482/144 |
| 2006/0035773 | A1 | * | 2/2006 | Kim | 482/145 |
| 2006/0040812 | A1 | * | 2/2006 | Teeter | 482/144 |

* cited by examiner

*Primary Examiner*—Lori Amerson
(74) *Attorney, Agent, or Firm*—David L. Davis

(57) ABSTRACT

A feet-binding apparatus for a tilting inversion exercise machine comprising an adjusting device, a control device, and an ankle holder. The adjusting device is connected to the tilting inversion exercise machine. The control device includes a pivoting member pivotably connected to the adjusting device, a ratchet fixed to the adjusting device and having a frictional portion, a pawl pivotably connected to the pivoting member and having a claw portion at an end thereof, a control bar fixed to the pivoting member at an end thereof, and an actuating rod inserted inside the control bar and pivotably connected to the other end of the pawl to be driven by a force to drive the claw portion to engage with or disengage from the frictional portion. The ankle holder includes a first binding cushion assembly fixed to the adjusting device, and a second binding cushion assembly fixed to the pivoting member.

9 Claims, 5 Drawing Sheets

FEET-BINDING APPARATUS FOR A TILTING INVERSION EXERCISE MACHINE

BACKGROUND OF THE INVENTION

1. Field of the Invention

The present invention relates generally to tilting inversion exercise machines and, more particularly, to a feet-binding apparatus for a tilting inversion exercise machine.

2. Description of the Related Art

A conventional tilting inversion exercise machine allows the user to pivot his/her body to be in an inverted position, thereby attaining exercise effect. To keep the user in an inverted position on the tilting inversion exercise machine, there must be a device to fixedly secure the user's feet so as to prevent the user from falling.

A conventional feet-binding apparatus mounted on a conventional tilting inversion machine is composed of a height-adjusting bar, a control bar pivotably connected with the height-adjusting bar, and two cushions respectively mounted on the height-adjusting bar and the control bar for respectively clamping the front and rear portions of the user's feet. After the user's feet are clamped by the two cushions, a hook of the height-adjusting bar is put to engage a plurality of lugs of the control bar, such that the user's feet can be firmly secured between the two cushions to avoid the risk of falling.

The aforedescribed feet-binding apparatus has to be operated to place the user's feet between the height-adjusting bar and the control bar, then move the control bar to tightly clamp the front and rear portions of the feet, and further enable the hook to be engaged with the lugs to complete the procedure of securing the feet. However, this procedure has been found to be very complex and inconvenient for the user.

In addition, another conventional feet-binding apparatus has a pin inserted into holes of the two cushions for fixedly securing the two cushions. However, when operating such feet-binding apparatus, it is necessary to first clamp the user's feet by the two cushions, and then to insert the pin into the corresponding hole, such that the whole procedure of binding the feet is still very complex and thus causes much inconvenience for the user.

SUMMARY OF THE INVENTION

An object of the present invention is to provide an improved feet-binding apparatus for a tilting inversion exercise machine, which can easily be operated to clamp and fixedly secure the user's feet in position.

Another object of the present invention is to provide an improved feet-binding apparatus for a tilting inversion exercise machine, which can keep the user safe during operation.

The foregoing objects of the present invention are attained by the inventive improved feet-binding apparatus that comprises an adjusting device, a control device, and an ankle holder. The adjusting device includes a plurality of locating holes for connecting to the tilting inversion exercise machine. The control device includes a pivoting member, a ratchet, a pawl, a control bar, and an actuating rod. The pivoting member is pivotably connected to the adjusting device so as to pivot with respect to the adjusting device. The ratchet is fixed to the adjusting device and is provided with a frictional portion. The pawl is pivotably connected to the pivoting member and is provided with a claw portion at an end thereof. The control bar is fixed to the pivoting member at an end thereof. The actuating rod is inserted inside the control bar and is pivotably connected to the other end of the pawl to be driven by a force to drive the claw portion of the pawl to engage with or disengage from the frictional portion of the ratchet, such that the pivoting member can be driven by the control bar to pivot with respect to the adjusting device. The ankle holder includes a first binding cushion assembly and a second binding cushion assembly. The first binding cushion assembly is fixedly mounted on the adjusting device. The second binding cushion assembly is fixed on the pivoting member of the control device to change the relative spacing between the first and second binding cushion assemblies by the pivoting of the pivoting member. Alternatively, the claw portion of the pawl engages the frictional portion of the ratchet to fixedly secure the relative spacing between the first and second binding cushion assemblies.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION OF THE INVENTION

Referring to FIGS. 1–5, a feet-binding apparatus 100 for a tilting inversion exercise machine and constructed according to a preferred embodiment of the present invention is composed of an adjusting device 10, a control device 20, and an ankle holder 30.

Figure 1:
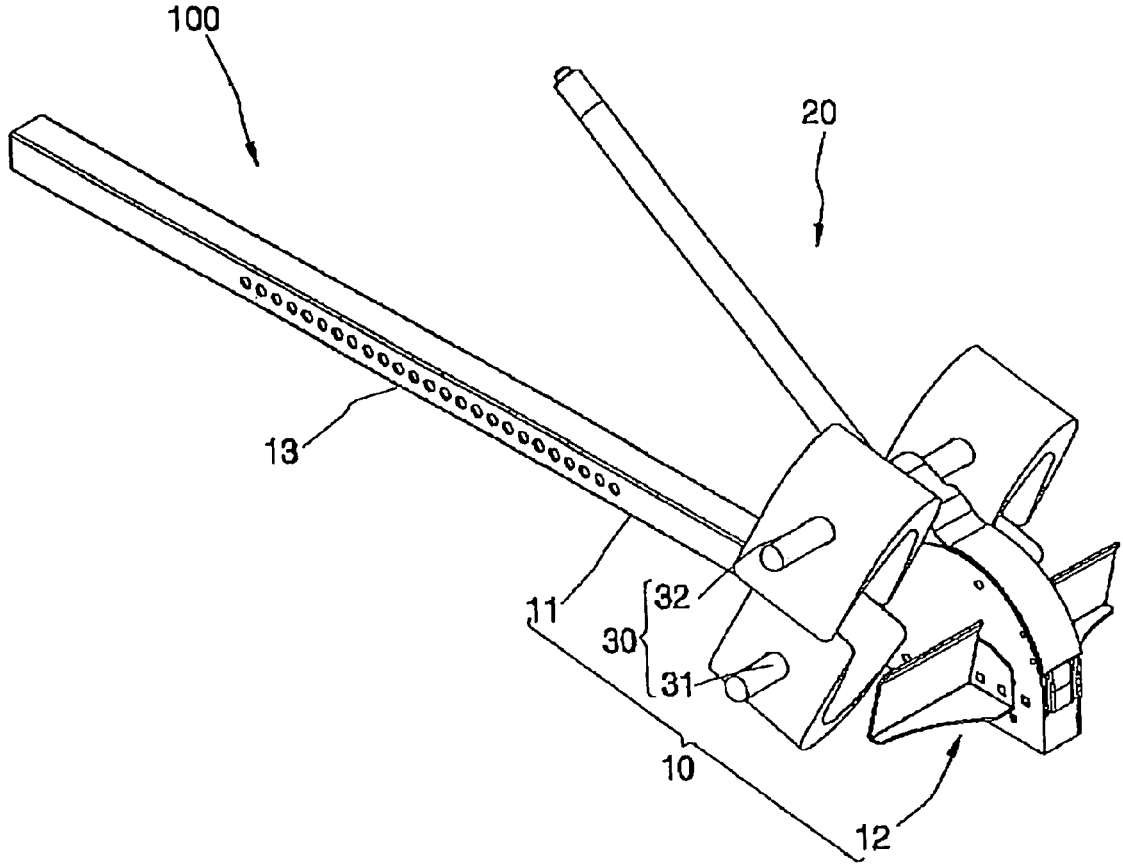
FIG. 1 is a perspective view of a preferred embodiment of the present invention.
Figure 2:
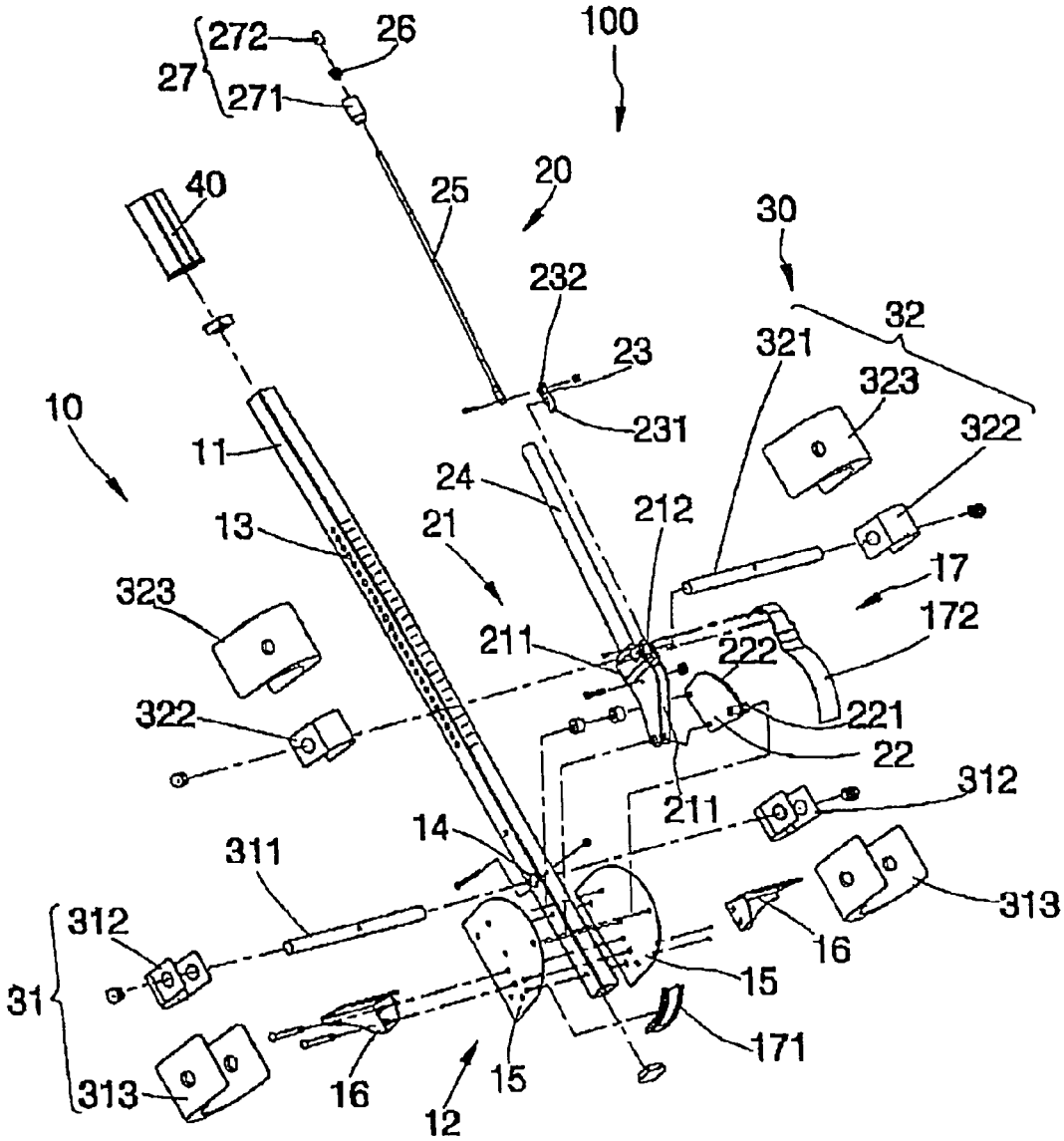
FIG. 2 is an exploded view of the preferred embodiment of the present invention.
Figure 3:
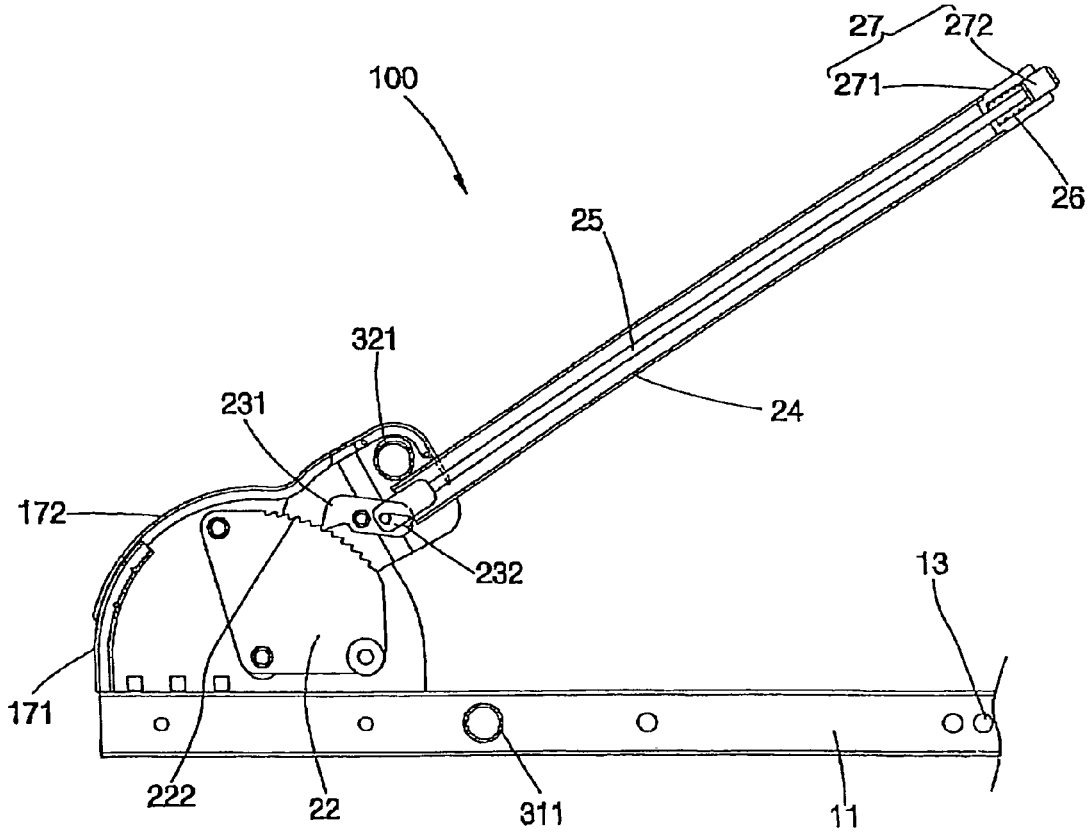
FIG. 3 is a sectional schematic view of the preferred embodiment of the present invention in operation.
Figure 4:
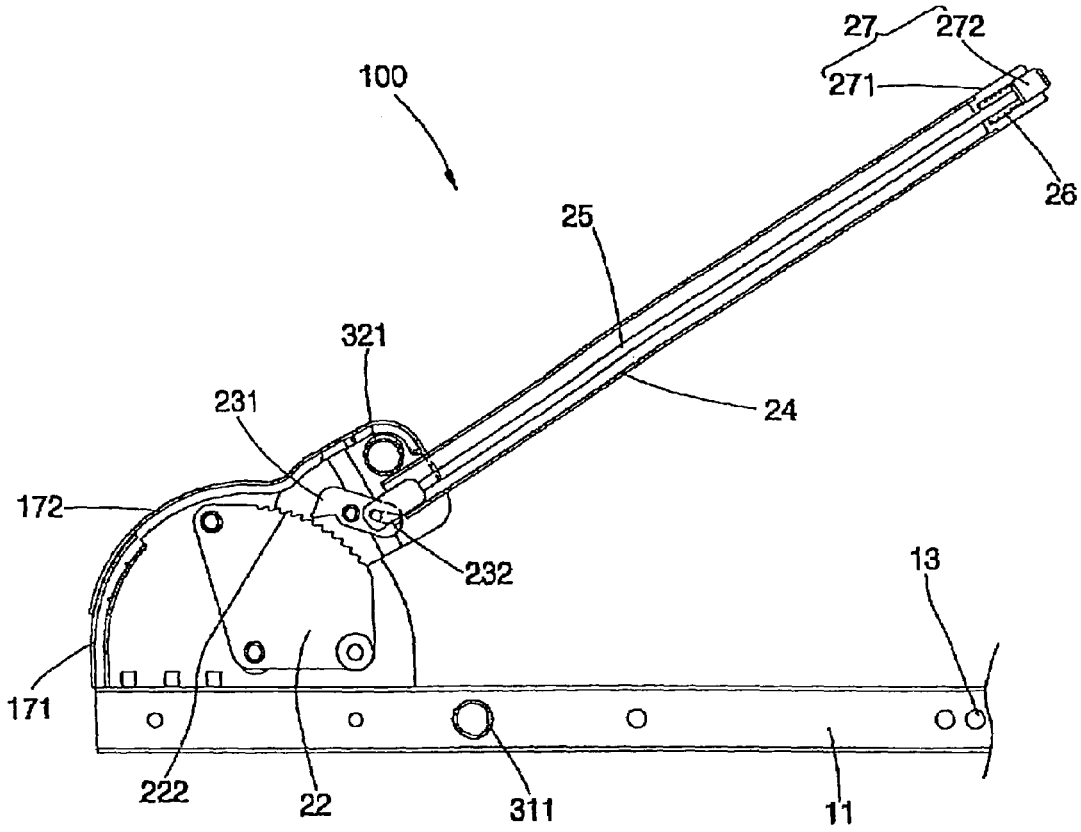
FIG. 4 is another sectional schematic view of the preferred embodiment of the present invention in operation.
Figure 5:
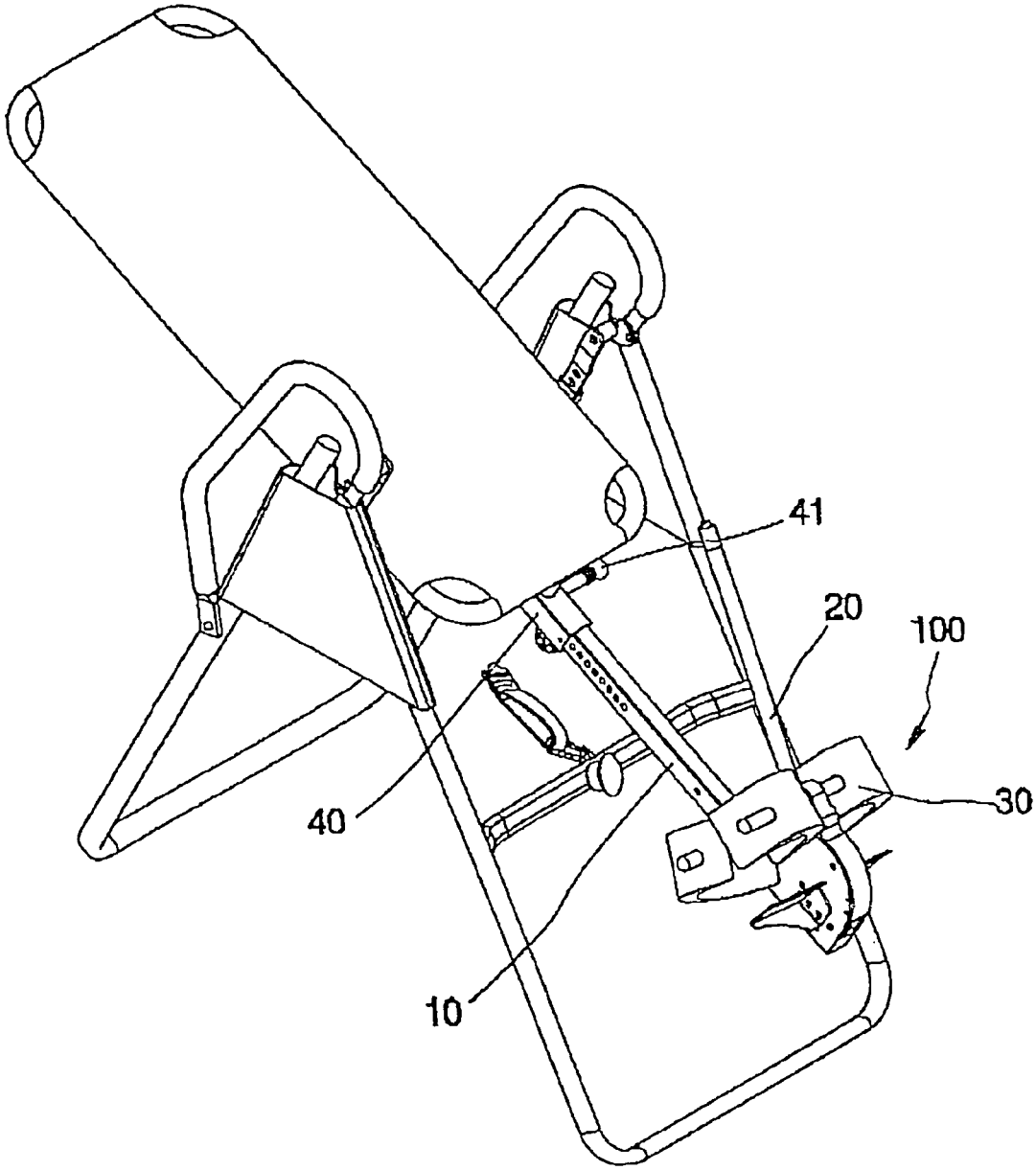
FIG. 5 is a perspective view of the preferred embodiment of the present invention mounted on a tilting inversion exercise machine.

The adjusting device 10 includes a fixed mount 12 and a non-circular adjusting bar 11 having a predetermined length. The adjusting bar 11 has a top end inserted into a sleeve 40 of the tilting inversion exercise machine, as shown in FIG. 5. A plurality of locating holes 13 are formed at a midsection of the adjusting bar 11 and run through two opposite sides thereof along a straight line for insertion therein of a pin 41 mounted on the sleeve 40. When the pin 41 is inserted into the different locating holes 13, the length of the adjusting bar 11 extending out of the sleeve 40 is variable to accommodate different users of different heights. The adjusting bar 11 further has a through hole 14 (FIG. 2) running through the two opposite sides of a distal end thereof. The fixed mount 12 has two fixed plates 15, two pedals 16, and a cover plate 17. The two fixed plates 15 are fixed respectively to the two opposite sides of the distal end of the adjusting bar 11 by screws and are positioned under the through hole 14. The two pedals 16 are for supporting the user's feet and are fixedly mounted respectively on the two fixed plates 15 by screws. The cover plate 17 has a slidable piece 171, a slidable cover 172, and a chute (not shown). The slidable piece 171 is fixedly mounted between the two fixed plates 15. The slidable cover 172 can be placed into the chute of the slidable piece 171 at an end thereof to be slidably moved along the slidable piece 171 by a force.

The control device 20 includes a pivoting member 21, a ratchet 22, a pawl 23, a control bar 24, an actuating rod 25, a biasing member 26, and a switch 27.

The pivoting member 21 has two pivoting plates 211 fixed with each other and each having a predetermined design, and a spacing formed between the two pivoting plates 211 and having a predetermined width. The two pivoting plates 211 are positioned between the two fixed plates 15 and each has an end pivotably connected with the fixed plates 15 to enable the pivoting member 21 to pivot relatively to the fixed plates 15 or the adjusting bar 11. Each of the pivoting members 21 has a through hole 212 running through the other end thereof. The slidable cover 172 of the adjusting device 10 is fixedly mounted on the pivoting member 21 at the other end thereof to enable the pivoting member 21 to be obscured by the slidable cover 172 and the two fixed plates 15 and to be driven by the pivoting member 21 to slidably move. The ratchet 22 is positioned between, and pivotably connected to, the two pivoting plates 211, and is fixed with the two fixed plates 15 to enable the pivoting member 21 to pivot relatively to the ratchet 22. The ratchet 22 has two retaining lugs 221 extending transversally outwards respectively from two sides of an end thereof for restraining the pivoting angle of the pivoting member 21 to keep the movement of the pivoting member 21 between the adjusting bar 11 and the retaining lugs 221. The ratchet 22 has a frictional portion 222 formed on a lateral edge thereof and having a plurality of tooth gaps in serial arrangement. The pawl 23 has a hooked claw portion 231 formed at an end thereof and an elongated slot 232 formed at bilateral sides of the other end thereof, being positioned between the two pivoting plates 211 and pivotably connected with the pivoting member 21. The control bar 24 is a tubular member and has an end fixedly mounted between the two fixed plates 211. The actuating rod 25 is an elongated rod inserted inside the control bar 24 and is pivotably connected with the slot 232 at an end thereof. The biasing member 26 is a spring. The switch 27 has a reception portion 271 and a button 272. The reception portion 271 is hollow inside and has an end fixed with the other end of the control bar 24, and a chamber for receiving the biasing member 26. The biasing member 26 has an end contacting a bottom side of the chamber. The button 272 is inserted through the other end of the reception portion 271 and into the chamber of the reception portion 271 to enable the other end of the actuating rod 25 to run through the biasing member 26 to further contact the button 272.

The ankle holder 30 includes a first binding cushion assembly 31 and a second binding cushion assembly 32.

The first binding cushion assembly 31 has a first shaft 311, two first tongues 312, and two first cushions 313. The first shaft 311 is inserted into the through hole 14 of the adjusting bar 11 to be secured in position by screws. Each of the first tongues 312 is a U-shaped resilient sheet and has two circular holes running through two opposite sides thereof. Each of the first cushions 313 is a U-shaped flexible padding and has two circular holes running through two opposite sides thereof. When assembling the aforementioned components, the two first tongues 312 are fitted respectively into the two first cushions 313, the circular holes of the two first tongues 312 and the two first cushions 313 are respectively aligned with each other to be inserted therethrough by the first shaft 311, and two screws are threadedly secured to two ends of the first shaft 321 to stop the two tongues 312 and the two first cushions 313 from separating from the first shaft 311.

The second binding cushion assembly 32 has a second shaft 321, two second tongues 322, and two second cushions 323. The second shaft 321 is inserted into the through hole 212 of the pivoting member 21 to be secured in position by screws. Each of the second tongues 322 is a U-shaped resilient sheet and has two circular holes running through two opposite sides thereof. Each of the second cushions 323 is a U-shaped flexible padding and has two circular holes running through two opposite sides thereof. When assembling the aforementioned components, the two second tongues 322 are fitted respectively into the two second cushions 323, the circular holes of the two second tongues 322 and the two second cushions 323 are respectively aligned with each other to be inserted therethrough by the second shaft 321, and two screws are threadedly secured to two ends of the second shaft 321 to stop the two tongues 322 and the two second cushions 323 from separating from the second shaft 321.

When the user intends to have his/her feet tightly clamped into the feet-binding apparatus 100, the button 272 of the control device 20 is depressed by the user's hand to squeeze the biasing member 26 to enable the biasing member 26 to be squeezed and deformed, the button 272 driving the actuating rod 25 to move downwards to further drive the pawl 23 to pivot on a pivot defined by the pawl 23 and the pivoting member 21 and to further disengage the claw portion 231 of the pawl 23 from the frictional portion 222 of the ratchet 22. While the button 272 is depressed, the control bar 24 pivots towards a direction against the adjusting bar 11, i.e. the control bar 24 pivots counterclockwise in FIG. 4, to drive the pivoting member 21 to pivot towards the same direction to further enable the first binding cushion assembly 31 to be driven to separate from the second binding cushion assembly 32, such that a gap between the first and second binding cushion assemblies 31 and 32 is enlarged to accommodate the user's feet. The aforementioned operation is required only while the gap between the first and second binding cushion assemblies 31 and 32 is too small to accommodate the user's feet; If he gap is sufficient to accommodate the user' feet, it is not necessary to perform the aforementioned operation, but instead the following operation is performed.

When the gap between the first and second binding cushion assemblies 31 and 32 is sufficient to accommodate the feet, the user can have the feet tread respectively on the pedals 16 and rear sides of the feet lie against the first cushions 313 of the first binding cushion assembly 31. In the meantime, the button 272 is depressed by the hand of the user to disengage the claw portion 231 of the pawl 23 from the frictional portion 222 of the ratchet 22, and the control bar 24 is pivoted toward the adjusting bar 11 (clockwise in FIG. 4) to enable the pivoting member 21 to move together with the control bar 24 to drive the second cushions 323 of the second binding cushion assembly 32 to tightly lie against the front sides of the user's feet. Next, the button 272 is released to enable the biasing member 26 to resiliently drive the button 272 to return to the position where the button 272 is not depressed and to simultaneously pull the actuating rod 25 to drive the pawl 23 to pivot. Meanwhile, the claw portion 231 and the frictional portion 222 are engaged to fixedly secure the relative position between the first and second binding cushion assemblies 31 and 32 to tightly clamp the user's feet, such that the user can safely operate the tilting inversion exercise machine 100 to do the exercise of tilting and inverting the body.

In addition, the claw portion and the frictional portion are adjustably engaged with one-way adjustability. In other words, while the user intends to push the control bar to drive the pivoting member or the second binding cushion assembly to pivot towards the adjusting bar, the claw portion can be driven to move to engage the next tooth gap of the frictional portion by directly pushing the control bar to pivot rather than pushing the button to disengage the pawl and the ratchet. When the user intends to push the control bar to pivot against the adjusting bar, it is required to push the button to disengage the pawl and the ratchet before the pivoting member pivots to enable the claw portion to engage the previous tooth gap of the frictional portion. Hence, it is required to push the button and the control bar at the same time to enlarge the gap between the first and second binding cushion assemblies, thereby rendering safer operation of the present invention than the prior art; it is easy to reduce the gap by pushing the control bar, thereby rendering more convenient operation for the present invention.

In conclusion, the present invention includes advantages as follows.

1. When the feet-binding apparatus 100 of the present invention is operated to clamp the user's feet, it is easy to reduce the gap between the first and second binding cushion assemblies by moving the control bar or moving the control bar together with pushing the button at the same time to tightly clamp the user's feet, thereby facilitating the operation of the present invention for the user.

2. The claw portion and the frictional portion are adjustably engaged by one-way stopping. In other words, it is required to push the button to enlarge the gap, such that the gap will not be enlarged to ensure that the user's feet can still keep clamped tight even if the user carelessly touches the control bar while the user is in tilted and inverted position, thereby enhancing safe operation of the present invention.

Accordingly, there has been disclosed an improved feet-binding apparatus for a tilting inversion exercise machine. While a preferred embodiment of the present invention has been disclosed, it will be appreciated that various modifications to the disclosed embodiment are possible without departing from the spirit and scope of the present invention. It is therefore intended that this invention be limited only by the scope of the appended claims.

What is claimed is:

1. A feet-binding apparatus for a tilting inversion exercise machine, said feet-binding apparatus comprising:

an adjusting device having a plurality of locating holes by which said adjusting device is connected to the tilting inversion exercise machine;

a control device having a pivoting member, a ratchet, a pawl, a control bar, and an actuating rod, said pivoting member being pivotably connected to said adjusting device to pivot relative to said adjusting device, said ratchet being fastened to said adjusting device and having a frictional portion, said pawl being pivotably connected to said pivoting member and having a claw portion at an end thereof, said control bar having an end fastened to said pivoting member, said actuating rod being inserted into said control bar and pivotably connected to the other end of said pawl to be driven by a force to drive said claw portion and said frictional portion to be engaged with or disengaged from each other; whereby when said claw portion and said frictional portion are disengaged from each other, said pivoting member can be driven by said control bar to pivot relative to said adjusting device; and an ankle holder having a first binding cushion assembly and a second binding cushion assembly, said first binding cushion assembly being fixedly mounted on said adjusting device, said second binding cushion assembly being fixedly mounted on said pivoting member of said control device, said pivoting member pivoting to change the relative spacing between said first and second binding cushion assemblies, said claw portion and said frictional portion being engaged to fixedly secure the relative spacing between said first and second binding cushion assemblies, wherein said tilting inversion exercise machine includes a sleeve, said adjusting device includes a non-circular adjusting bar having a predetermined length, said adjusting bar being inserted into said sleeve of said tilting inversion exercise machine; said locating holes are positioned at an external side of said adjusting bar for receiving a pin mounted on said sleeve, said pin being inserted into different ones of said locating holes to change the length of said adjusting bar extending out of said sleeve for accommodating different users of different heights, and wherein said adjusting device further comprises a fixed mount, said fixed mount having two fixed plates, two pedals, and a cover plate, said two fixed plates being fixedly mounted respectively on two opposite sides of a distal end of said adjusting bar extending out of said sleeve, said two fixed plates being pivotably connected with said pivoting member, said two pedals being fixedly mounted respectively on said two fixed plates for the user's feet treading thereon, said cover plate having a slidable piece and a slidable cover, said slidable piece being fixedly mounted between said two fixed plates and having a chute, said slidable cover having an end inserted into said chute and the other end fixedly mounted on said pivoting member to enable the slidable cover to be driven by said pivoting member to slidably move along said chute.

2. A feet-binding apparatus for a tilting inversion exercise machine, said feet-binding apparatus comprising:

an adjusting device having a plurality of locating holes by which said adjusting device is connected to the tilting inversion exercise machine;

a control device having a pivoting member, a ratchet, a pawl, a control bar, and an actuating rod, said pivoting member being pivotably connected to said adjusting device to pivot relative to said adjusting device, said ratchet being fastened to said adjusting device and having a frictional portion, said pawl being pivotably connected to said pivoting member and having a claw portion at an end thereof, said control bar having an end fastened to said pivoting member, said actuating rod being inserted into said control bar and pivotably connected to the other end of said pawl to be driven by a force to drive said claw portion and said frictional portion to be engaged with or disengaged from each other; whereby when said claw portion and said frictional portion are disengaged from each other, said pivoting member can be driven by said control bar to pivot relative to said adjusting device; and an ankle holder having a first binding cushion assembly and a second binding cushion assembly, said first binding cushion assembly being fixedly mounted on said adjusting device, said second binding cushion assembly being fixedly mounted on said pivoting member of said control device, said pivoting member pivoting to change the relative spacing between said first and second binding cushion assemblies, said claw portion and said frictional portion being engaged to fixedly secure the relative spacing between said first and second binding cushion assemblies, wherein said control device further comprises a biasing member and a switch, said switch having a reception portion and a button, said reception portion being hollow and having an end fastened with the other end of said control bar, said biasing member being positioned inside said reception portion, said button contacting against the other end of said actuating rod to control the movement of said actuating rod, said biasing member generating a resilience against said button to keep said button holding said actuating rod to further enable said claw portion of said pawl and said frictional portion of said ratchet to be engaged with each other.

3. The feet-binding apparatus as defined in claim 1, wherein said frictional portion comprises a plurality of tooth gaps arranged in seriation; and said claw portion is hooked.

4. The feet-binding apparatus as defined in claim 1, wherein said pivoting member comprises two pivoting plates each having a predetermined design and fastened with each other, said two pivoting plates defining therebetween a spacing having a predetermined width, each of said two pivoting plates having an end pivotably connected to said adjusting device, said ratchet being positioned in said spacing and fastened to said adjusting device to enable said pivoting member to pivot relative to said ratchet.

5. The feet-binding apparatus as defined in claim 1, wherein said ratchet further comprises two retaining lugs extending transversally outwards respectively from two sides of an end of said ratchet for keeping the movement of said pivoting member between said adjusting bar and said retaining lugs.

6. The feet-binding apparatus as defined in claim 2, wherein said frictional portion comprises a plurality of tooth gaps arranged in seriation; and said claw portion is hooked.

7. The feet-binding apparatus as defined in claim 2, wherein said pivoting member comprises two pivoting plates each having a predetermined design and fastened with each other, said two pivoting plates defining therebetween a spacing having a predetermined width, each of said two pivoting plates having an end pivotably connected to said adjusting device, said ratchet being positioned in said spacing and fastened to said adjusting device to enable said pivoting member to pivot relative to said ratchet.

8. The feet-binding apparatus as defined in claim 2, wherein said ratchet further comprises two retaining lugs extending transversally outwards respectively from two sides of an end of said ratchet for keeping the movement of said pivoting member between said adjusting bar and said retaining lugs.

9. The feet-binding apparatus as defined in claim 2, wherein said biasing member comprises a spring.

* * * * *